United States Patent [19]

von der Eltz et al.

[11] Patent Number: 4,862,545

[45] Date of Patent: Sep. 5, 1989

[54] METHOD FOR THE REMOVAL OF FABRIC SAMPLES FROM HT JET DYEING MACHINES WITHOUT LOSS OF LIQUOR

[75] Inventors: Hans-Ulrich von der Eltz, Frankfurt am Main; Wilhelm Christ, Michelbach/Bilz, both of Fed. Rep. of Germany

[73] Assignee: Hoechst Aktiengesellschaft, Fed. Rep. of Germany

[21] Appl. No.: 221,760

[22] Filed: Jul. 20, 1988

[30] Foreign Application Priority Data

Jul. 21, 1987 [DE] Fed. Rep. of Germany ..... 3724074

[51] Int. Cl.[4] ..... D06B 3/28

[52] U.S. Cl. ..... 8/149.1; 8/152; 8/158; 68/5 C; 68/178

[58] Field of Search ..... 8/149.1, 149.2, 149.3, 8/152, 158; 68/5 C, 13 R, 177, 178, 185

[56] References Cited

U.S. PATENT DOCUMENTS

| | | | |
|---|---|---|---|
| 3,921,420 | 11/1975 | Aurich et al. | 68/5 C |
| 3,949,575 | 4/1976 | Turner et al. | 68/5 C |
| 4,351,076 | 9/1982 | von der Eltz et al. | 8/149.1 |
| 4,483,032 | 11/1984 | Christ et al. | 68/178 X |

*Primary Examiner*—Philip R. Coe

*Attorney, Agent, or Firm*—Connolly & Hutz

[57] ABSTRACT

After a dyeing operation has been concluded, the hot dyeing liquor present in the piece dyeing jet is returned via a cooling heat exchanger in the dyeing circulation system back into the makeup storage vessel for the dyeing liquor. Thereafter, the liquor-free dyeing system, which is still under an elevated static pressure, is relieved to atmospheric whereby the dyeing system is cooled down adiabatically together with the dyed textile material present therein to such an extent that a sample can be taken therefrom rapidly and safely.

6 Claims, 2 Drawing Sheets

Figure 1:
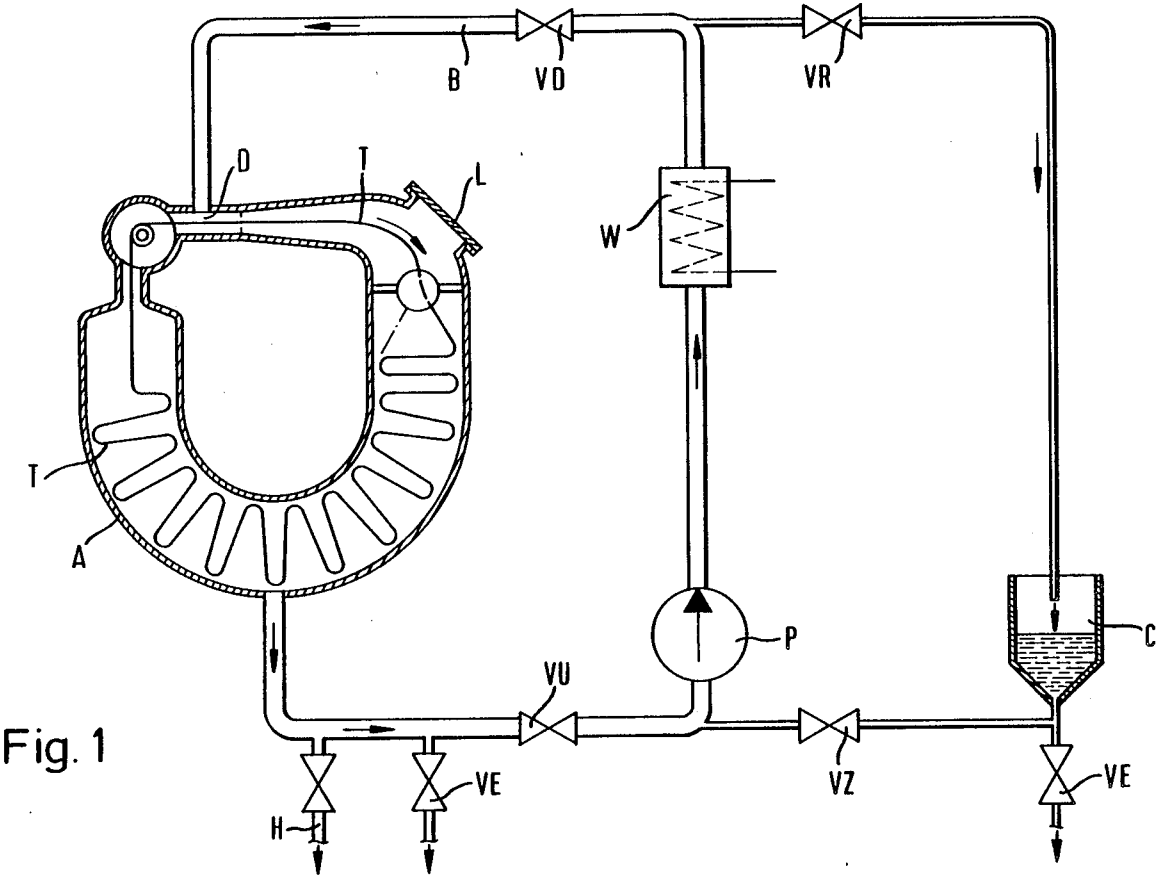

METHOD FOR THE REMOVAL OF FABRIC SAMPLES FROM HT JET DYEING MACHINES WITHOUT LOSS OF LIQUOR

The present invention relates to a method for the simple removal, without loss of liquor, of dyeing samples from ropes of textile woven or knitted fabric discontinuously circulating in continuous loop form in HT-jet piece dyeing machines following a preceding wet treatment operation of dyeing by the exhaust technique, the forward feed for propelling the textile material within the self-contained jet unit having been effected either hydraulically by actuation of the liquid-operated jet arrangement and/or aerodynamically by actuation of the steam- or gas-operated jet arrangement and the dyeing liquor having been circulated in the same direction.

Matching of dyed or printed goods comprises comparing the result of an operation on a lot with the color sample to be copied in dyeing to a particular shade. The assessment of whether the dyeing is on shade is in practice usually only done visually, i.e. subjectively. There can be big differences in observation, even between people of normal color vision. In contentious cases it is therefore necessary to carry out an accurate color measurement. In the event of nonconformity (color differences) with the shade prototype to be matched, the dyeing is therefore followed by topping, i.e. adding of further dye to the liquor, or in severe shade derivation - following partial stripping of the color - by carrying out a completely new dyeing procedure.

In order to check the state of a dyeing as regards the shade obtained, i.e. as to whether it is on shade, it is necessary to take samples in the course of the dyeing process. When exactness of shade of the coloration is achieved, the dyed goods are rinsed and aftertreated. If, however, it is found that the dyeing result is not on shade, it is again necessary to take tinctorial measures to get the desired shade. To save water, energy and auxiliaries if it becomes necessary to correct differences in shades detected in the abovementioned way, it is generally customary, if the dyeing is to be continued, to proceed with utilizing the liquor already in use. Aside from the aforesaid savings this also results in lower pollution of the effluent originating therefrom.

There are a number of different methods for obtaining such samples of dyed fabric without too much effort in HT-dyeing:

The most complicated of these methods comprises the use of a specific sampling apparatus which makes it possible without changing the conditions in the dyeing system (maintenance of temperature and pressure) to take a sample which has undergone the treatment cycle in a side circulation system relative to the dyeing circulation system or directly in the latter. However, it has been found here that the conformity between the lot and the sample which has been taken is frequently inadequate, in particular when commission dyers and finishers are asked to perform the virtually impossible in shade matching.

The second and probably the most widely practiced method comprises cooling the entire dyeing system of goods and liquor to temperatures below 100° C., if an HT dyeing is present, and then cutting the sample directly from the dyed lot. With this method there is optimum conformity between sample and lot, but as a consequence of the lowering of the temperature which is typical of this method the entire system, if required, may have to be heated up again.

The third way of taking a sample of dyed fabric is offered by modern HT jet dyeing machines which have a so-called HT-drain. On discharging the liquor under HT conditions the entire system is cooled down, albeit with complete loss of the liquor, so that the sample can be taken from the dyed lot.

Modern jet dyeing machines are under the increased static pressure of the hot liquor at 120° to 130° C. throughout the dyeing process. It is thus the object of the present invention to make the taking of samples of high temperature (HT) dyeings as effective as possible and to keep the liquor used in readiness for further use at the highest possible temperature for the purposes of any subsequent topping until the dyeing is true to shade.

This object is achieved according to the invention by, first of all, interrupting the circulation of the dyeing liquor present under high temperature (HT) conditions and separating the said liquor from the textile material and hence from the actual dyeing system, passing this liquor out of the non-operating circulation system through a heat exchanger available therein, which has been switched to cooling, to cool the liquor to temperatures below 100° C. The next steps involved returning the so-cooled liquor into the attached (preferably empty) makeup vessel for the dissolved/dispersed treating agent (for example dye), thereafter releasing the elevated vapor pressure yet present in the then liquor-free dyeing system of the jet unit, which is still under HT conditions, back to the atmospheric state and to bring about a corresponding adiabatic cooling of the dyed textile material present therein together with a simultaneous loosening of the packing density of said textile material, and, finally, after the jet unit has been opened, taking the dyeing sample directly from the dyeing produced.

Depending on the different measures employed for transporting the textile material in rope form through the dyeing jet, some variations result therefrom within the scope for carrying out of the present invention. For instance, if the material transport is effected aerodynamically, the dyed textile material, after the pressure has been released in the dyeing system, may advantageously be kept in circulation with the drive gas flow. On the other hand, if the material rope is propelled by exclusively hydraulic means, the circulation of the dyed textile material is no longer maintainable already directly after the storage space has been emptied from the dyeing liquor, i.e. before the envisioned release of pressure in the dyeing system, since from then on there is no longer any liquid drive agent present for the forward movement of the textile material.

If, after the sample has been taken according to the invention, the subsequent comparative assessment of the dyeing produced still shows deviations in shade to be present from the pattern to be matched, then, to remedy such an irregularity, i.e. to obtain the required on shade dyeing, the dyeing liquor previously removed from the dyeing (or circulation) system and after it has been charged with the additional dye is again fed into the jet unit, which has in the meantime been resealed pressure-tight, the circulation of the liquor is restarted with the forward movement due to the return of the liquor from the makeup vessel, and thereafter the dyeing process is resumed.

Figure 2:
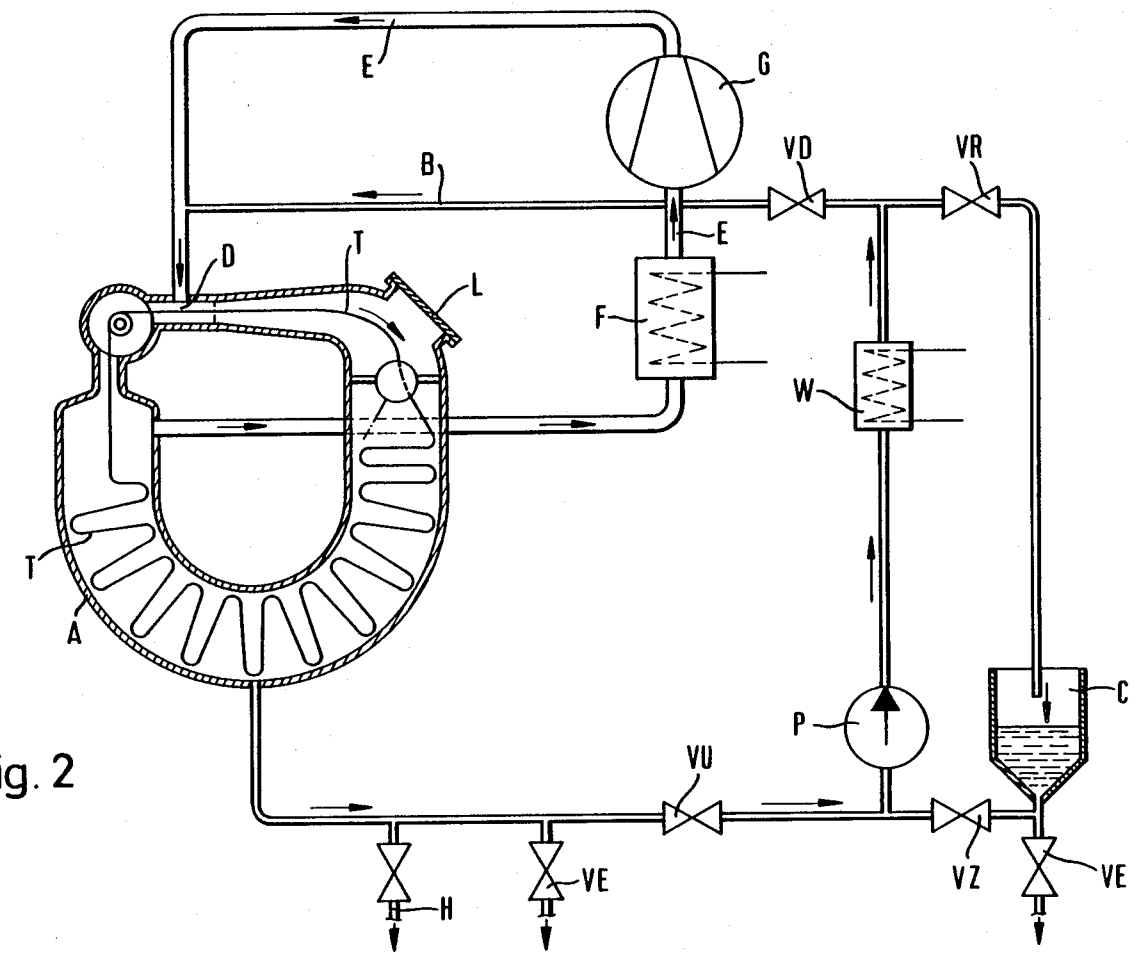

Working examples of jet piece dyeing machines used according to the invention are depicted in cross-section in the accompanying drawings, where FIG. 1 shows the plan of a jet dyeing unit with hydraulic cloth transport and FIG. 2 shows the plan of a jet dyeing unit with aerodynamic cloth transport.

The reference symbols used therein are identical to the letters used for this purpose in the text and have the following meanings:

A=Dyeing jet comprising a pressure vessel with an essentially ring-shaped cloth circulation path, including mechanically drivable guide roll (reel), transport nozzle and cloth storage space including run-off point.

B=Circulation system for the liquor, comprising a circulation valve with a downstream circulation pump, a heat exchanger for heating or cooling and a throttling means for regulating the liquor flow.

C=Makeup and reservoir vessel for treatment liquids with downstream add or block-off valve.

D=Nozzle section which permits a choice between hydraulic or aerodynamic propulsion of the textile material in rope form.

E=Separate gas circulation system which in use is under the overpressure created by the built-in blower and contains on the suction side thereof an upstream air heater.

F=Air heater
G=Blower (compressor)
H=HT-drain
L=Hatch for sampling
P=Pump for keeping the liquor in circulation
T=Textile material
VD=Throttle valve
VE=Emptying valves
VR=Return valve
VU=Circulation valve
VZ=Add valve
W=Heat exchanger for the liquor The representation of the jet dyeing machine depicted in FIGS. 1 and 2 conforms largely to the prototype of such apparatus as described in detail in U.S. Pat. No. 3,949,575.

The principle of functioning of the apparatus variants explained above can be illustrated as follows:

To perform the envisioned wet processing treatment i.e. the dyeing process, the dyeing jet (A) of FIG. 1 is first charged with the continuous loop fabric rope (T) and, with the add valve (VZ) in the open position, filled with treating (dyeing) liquor from the makeup vessel (C). The propulsion of the fabric is then accomplished in conformity with the variant of FIG. 1 through the effect of the hydraulically acting circulation system (B). To this end, the treating liquor is withdrawn at the bottom of the cloth storage space of (A) and then flows along line (B) with the aid of the activated circulation pump (P) through the heat exchanger (W) and the open throttle valve (VD) [the return valve (VR) is in the closed position in the meantime] toward the nozzle system (D) wherein the liquor impinges tangentially on the fabric rope (T) and imparts to the same the desired kinetic impulse in the direction of the cloth store (A). At this juncture the textile material (T) is saturated by the impinging liquor and, depending on the temperature and pressure conditions prevailing there, immediately undergoes fixation of the treating agent, in particular dye, applied this way. The superfluous portions of the liquor used which exceed the liquor holding capability of the fiber material (T) are collected in the bottommost sector of the fabric store (A) and thereafter enter again into the circulation system (B) for the treating liquor responsible for the fabric transport.

With the variant of FIG. 2, in the absence of the liquid driving agent, a (hot) gas steam which, passed toward the nozzle system (D) in the separate circulation system (E) via the air heater (F) and blower (G) comes into contact there with the fabric rope (T) present in the dyeing jet (A) in otherwise the same form as in FIG. 1, brings about the forward movement of the fabric (T) through the jet unit. At the same time, the treating agent prepared in liquid form, in particular a dye solution, and carried in the liquor cycle (B) through the opened throttle valve (VD) [the return valve (VR) stays closed here] is injected in atomized form upstream of the nozzle section (D) into the drive gas, which has conveniently been heated to fixing conditions, and in this way applied to the circulating textile material (T).

To remove a sample from the textile material exhaust-dyed in the above manner, then, the invention proposes that in both cases the throttle valve (VD) be closed and the return valve (VR) opened while at the same time the heat exchanger (W) be switched to cooling. With this setting, the liquor which has cooled down in the meantime is returned (in both cases) with the aid of the pump (P) through the return valve (VR) into the makeup vessel (C) and can be introduced again from there into the system via the add valve (VZ) should this be required by the state of the dyeing. As soon as the liquor has been removed toward the makeup vessel (C), the return valve (VR) is closed, the throttle valve (VD) is opened again and the pressure released of the system is then brought about via the HT-drain (H). Adiabatic cooling then rapidly cools down the system while the evaporation of the moisture in the textile material being dyed opens out the latter in respect of its packing density. Creases are substantially avoided as a result.

The hatch (L) is then opened and the sample removed from the dyed material. If the shade on the dyed material matches the pattern to be copied, the liquor can be discharged from the makeup vessel (C) and the after-treatment of the dyeing be initiated. If the shade on the dyed material is not on shade, the treating liquor in the makeup vessel (C) is charged with the necessary amount of dye and is then introduced again via the add valve (VZ) into the resealed jet unit, and the dyeing process is continued.

The process of the present invention is particularly advantageous to carry out in jet units conforming to FIG. 2 which propel the textile material aerodynamically, since in this case the movement of material need never be stopped, except for the taking of the sample itself. In the other system, where the textile material is advanced hydraulically, the textile material should be kept moving at least by guiding rolls for as long as the liquor circulation is not in operation. If, however, such an ongoing movement cannot be accomplished, the transport of the textile material is stopped shortly before actuation of the HT-drain (H), the pressure is released, and the sample is then taken via the hatch (L). By pumping back the liquor via the add valve (VZ), the circulation of the textile material is then again set in motion.

We claim:

1. In a method for removing, without loss of dyeing liquor, a dyeing sample from a rope of textile material discontinuously circulating in continuous loop form in a jet piece dyeing machine following a preceding wet treatment operation of dyeing by an exhaust technique under high temperature conditions, hydraulically propelling the textile material within a self-contained jet unit of the machine, and continuously circulating the dyeing liquor into, through and out of the dyeing machine in the same direction as the fabric material is propelled, the improvement comprising interrupting the circulation of the dyeing liquor being pressurized corresponding to the conditions of the high temperature operation and separating the dyeing liquor from the textile material by removing the dyeing liquor from the dyeing machine, passing the dyeing liquor so removed through a heat exchanger, operating the heat exchanger to cool the dyeing liquor to a temperature below 100° C., flowing the cooled dyeing liquor from the heat exchanger to a makeup vessel where the liquor is stored, thereafter relieving any elevated pressure originating from the high temperature conditions and being still present in the liquor-free machine back to atmospheric to thereby bring about a corresponding adiabatic cooling of the textile material present in the machine together with a simultaneous loosening of the packing density of the textile material, opening the machine, and taking a dyeing sample directly from the dyed textile material.

2. The method of claim 1 in which the hydraulically propelling of the textile material within the self-contained jet unit stops when the dyeing liquor is removed prior to relieving pressure in the dyeing machine.

3. The method of claim 1 including the step of aerodynamically propelling the textile material within the self-contained jet unit by introducing and circulating a gas stream through the dyeing machine during and after the dyeing liquor is removed therefrom.

4. The method of claim 3 in which the textile material is aerodynamically propelled within the self-contained jet unit even after the pressure in the dyeing machine has been relieved and continues to be so propelled until just prior to taking the dyeing sample.

5. The method of claim 1 including the step of mechanically propelling the textile material within the self-contained jet unit of the dyeing machine during and after the dyeing liquor is removed therefrom.

6. The method of claim 1 including the further step of continuing to dye the textile material after the dyeing sample by resealing the dyeing machine pressure tight, returning the dyeing liquor from the makeup vessel, with or without replenishment dyeing liquor, to the dyeing machine, and circulating the dyeing liquid through the machine.

* * * * *

UNITED STATES PATENT AND TRADEMARK OFFICE

CERTIFICATE OF CORRECTION

PATENT NO. : 4,862,545

DATED : September 5, 1989

INVENTOR(S) : Hans-Ulrich Von der Eltz

It is certified that error appears in the above-identified patent and that said Letters Patent is hereby corrected as shown below:

In column 4, line 6, change "steam" to -- stream --.

In column 6, line 20, -- taking -- should be inserted after "after".

Signed and Sealed this

First Day of January, 1991

*Attest:*

*Attesting Officer*

HARRY F. MANBECK, JR.

*Commissioner of Patents and Trademarks*